US005846004A

United States Patent [19]

Sparshott

[11] Patent Number: 5,846,004

[45] Date of Patent: Dec. 8, 1998

[54] IMPACT PRINT HEAD

[75] Inventor: John Andrew Sparshott, Hurst, United Kingdom

[73] Assignee: Newbury Data Recording Limited, Winsford, United Kingdom

[21] Appl. No.: 551,374

[22] Filed: Nov. 1, 1995

[30] Foreign Application Priority Data

Nov. 2, 1994 [GB] United Kingdom ..... 9422117

[51] Int. Cl.[6] ..... B41J 2/235

[52] U.S. Cl. ..... 400/124.11; 101/93.05

[58] Field of Search ..... 400/124.28, 124.11, 400/124.12; 101/93.05

[56] References Cited

U.S. PATENT DOCUMENTS

| | | | |
|---|---|---|---|
| 4,101,017 | 7/1978 | Englund et al. | 400/124 |
| 4,236,836 | 12/1980 | Hodne | 400/124 |
| 4,279,521 | 7/1981 | Kightlinger | 400/124.28 |
| 4,453,840 | 6/1984 | Hodne | 400/124 |
| 4,462,706 | 7/1984 | Matschke | 400/124 |
| 4,572,070 | 2/1986 | Moulin | 101/93.05 |
| 4,700,625 | 10/1987 | Bauer | 400/124.12 |
| 4,867,583 | 9/1989 | Caulier et al. | 400/124.29 |
| 4,915,517 | 4/1990 | Husome | 400/124 |
| 5,236,266 | 8/1993 | Mitsuishi et al. | 400/124 |
| 5,349,903 | 9/1994 | Moriyama et al. | 101/93.05 |

FOREIGN PATENT DOCUMENTS

| | | |
|---|---|---|
| 0026549 | 9/1980 | European Pat. Off. . |
| 2084831 | 12/1971 | France . |
| 2154201 | 5/1973 | France . |
| 04177907 | 1/1994 | Japan . |
| 1558001 | 12/1979 | United Kingdom . |
| 2049559 | 12/1980 | United Kingdom . |
| WO 8403256 | 8/1984 | WIPO . |

OTHER PUBLICATIONS

European Search Report 13 Oct. 1997 Examiner J.P. Meulemans, The Hague.

"Offset Alignment of Core for Wire Matrix Printhead" IBM Technical Disclosure Bulletin, vol. 35, no. 6, pp. 414–415, Nov. 1992.

*Primary Examiner*—David A. Wiecking
*Attorney, Agent, or Firm*—Joseph Levinson

[57] ABSTRACT

A construction of dot matrix print head is disclosed in which a plurality of body elements, each carrying print wire actuators, are arranged in stacked formation. The body elements and the arrangement of actuators is identical so that by offsetting the body elements relative to adjacent body elements, print wires actuated by actuators of one body member are inter-digitated with print wires actuated by actuators of a body member adjacent said one body member. This construction permits the actuators to be accommodated in a print head of relatively small transverse dimensions.

4 Claims, 3 Drawing Sheets

IMPACT PRINT HEAD

BACKGROUND OF THE INVENTION

This invention relates to print heads and in particular to construction of dot impact print heads in which print wires are driven selectively toward a print receiving medium to form a required printed impression.

Dot impact print heads in which print wires are driven toward a print receiving medium are known and one example of a construction of such a print head is disclosed in the specification of GB patent No. 2081650. A group of print wires have front ends thereof supported in a front guide such that the front ends are disposed in a line. The print wires extend from the guide rearwardly and fan out such that rear ends of the wires are disposed in a circular formation. A group of actuators are disposed in a circular formation around the rear ends of the wires, the actuators being associated one with each print wire respectively. The actuators comprise an electromagnet secured to a frame or chassis of the print head and a pivoted armature cooperating with the rear end of the print wire associated with that actuator. Energisation of the electromagnet causes the armature to pivot and drive the print wire lengthwise such that the front end of the print wire moves in the front guide to impact with an inked ribbon and print receiving medium. The inked ribbon passes between the print head and the print receiving medium and hence impact of the front end of a driven print wire with the inked ribbon results in printing of a dot on the print receiving medium. By selectively driving the print wires, while the print head is moved relative to the print receiving medium in a direction perpendicular to the line of print wires, a required print impression is built up line by line.

Generally the print head contains a group of print wires with the front ends thereof disposed in a line. In order to provide improved clarity of printing the print head is commonly provided with a second group print wires with the front ends thereof disposed in a second line. The front ends of the wires of the second group are offset in the line relative to the first mentioned group so that dots printed by the second group of print wires are printed in positions intermediate dots printed by the first group of wires. A print head with one or two groups of 9 or 18 print wires is capable of printing a line of characters, the extent of the front ends of the print wires along the line thereof being sufficient to encompass the height of each character to be printed. It will be appreciated that, for a required force to be applied to drive the print wires, there is a practical limit to the miniaturisation of the actuators and hence the overall size of print head is determined by the number of print wires.

There is a requirement to be able to print over an extent considerably greater than that of a single character height so that text may be printed in a number of lines simultaneously. This requires the provision of a considerably greater number of print wires than customary for single line printing. In order to accommodate the print head within the printer mechanism there is a practical limit to the overall size of the print head. The increased number of actuators required for such an increased number of print wires would if disposed in a conventional arrangement result in an unacceptably large print head.

The present invention is concerned with providing a more compact construction of print head.

SUMMARIES OF THE INVENTION

According to one aspect of the invention an impact print head comprises a plurality of substantially straight print wires located substantially parallel to one another by guide means; said print wires having a front end for impact with an ink transfer medium and having a rear end; a plurality of actuators associated one with the rear end of each print wire respectively and each actuator being selectively energisable to drive the print wire associated therewith lengthwise from a rest position toward an operative printing position; said print head including at least first and second support elements; a first group of said actuators being mounted on said first support element and a second group of said actuators being mounted on said second support element; a first group of said print wires extending to said first group of actuators on said first support element and being drivable by energisation of said first group of actuators; a second group of said print wires extending through said first support element to said second group of actuators on said second support element and being drivable by energisation of said second group of actuators; said first and second support elements and the location of the first and second groups of actuators respectively mounted thereon being substantially identical; and location means effective to align said first and second support elements offset transversely to one another such that print wires of said first and second groups are inter-digitated.

According to a second aspect of the invention an impact print head includes a stack of a plurality of support elements; a first support element of the stack being located adjacent a front of the print head; a plurality of groups of actuators, the groups of actuators being mounted respectively one on each support element; a plurality of print wires associated one with each actuator respectively; front ends of the print wires being located in a line at the front of the print head and extending in substantially parallel formation to the actuators associated therewith, print wires associated with actuators mounted on any one of said support elements further from the front of the print head than the first support element passing through guide apertures in support elements located in the stack between the front of the print head and said any one support element; said support elements and the location of the group of actuators respectively mounted thereon being substantially identical; and location means effective to align said elements offset transversely to one another such that print wires of said first and second groups are inter-digitated.

BRIEF DESCRIPTION OF THE DRAWING

An embodiment of a print head constructed in accordance with the invention will now described by way of example with reference to the drawings in which.

DESCRIPTION OF THE PREFERRED EMBODIMENT

Figure 1:
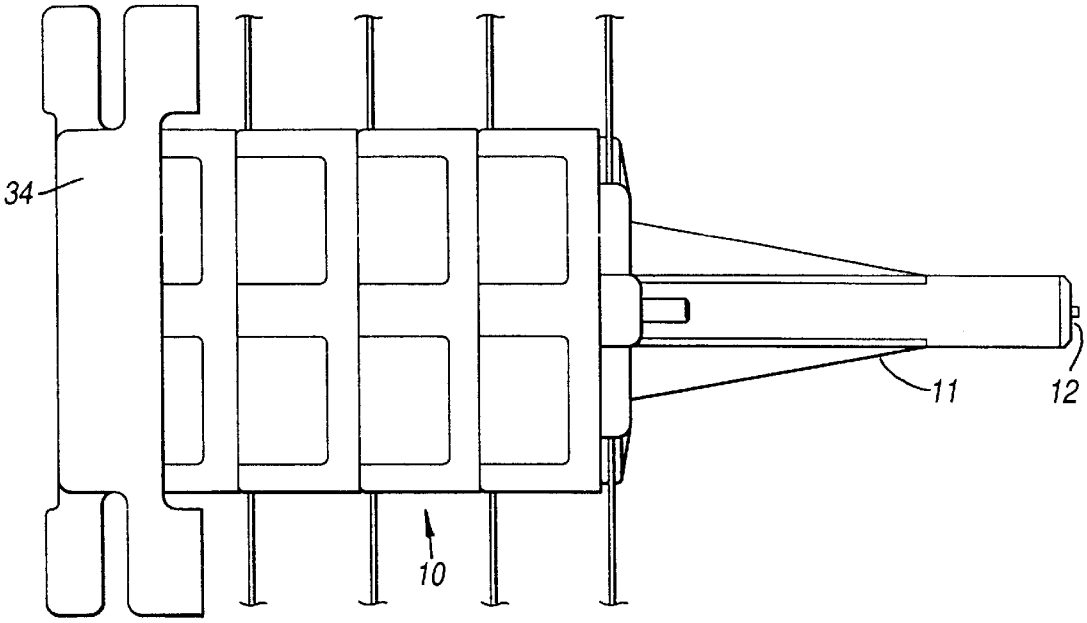
FIG. 1 is a side elevation of a print head.
Figure 2:
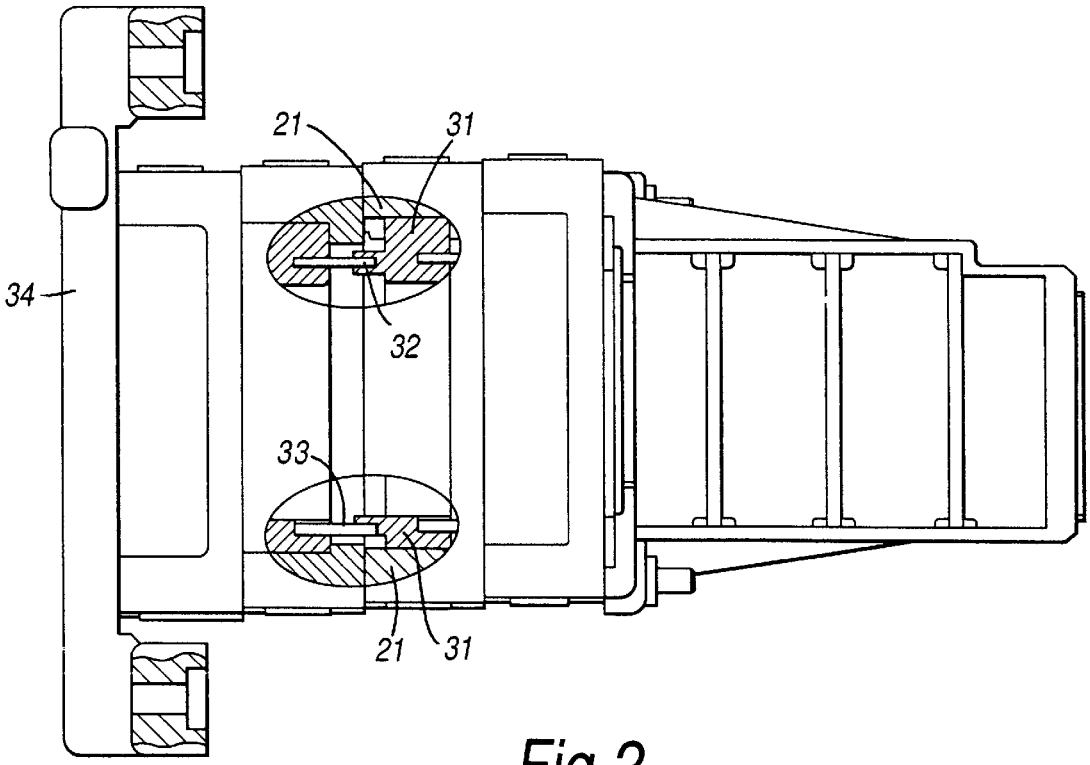
FIG. 2 is a front elevation of the print head.
Figure 3:
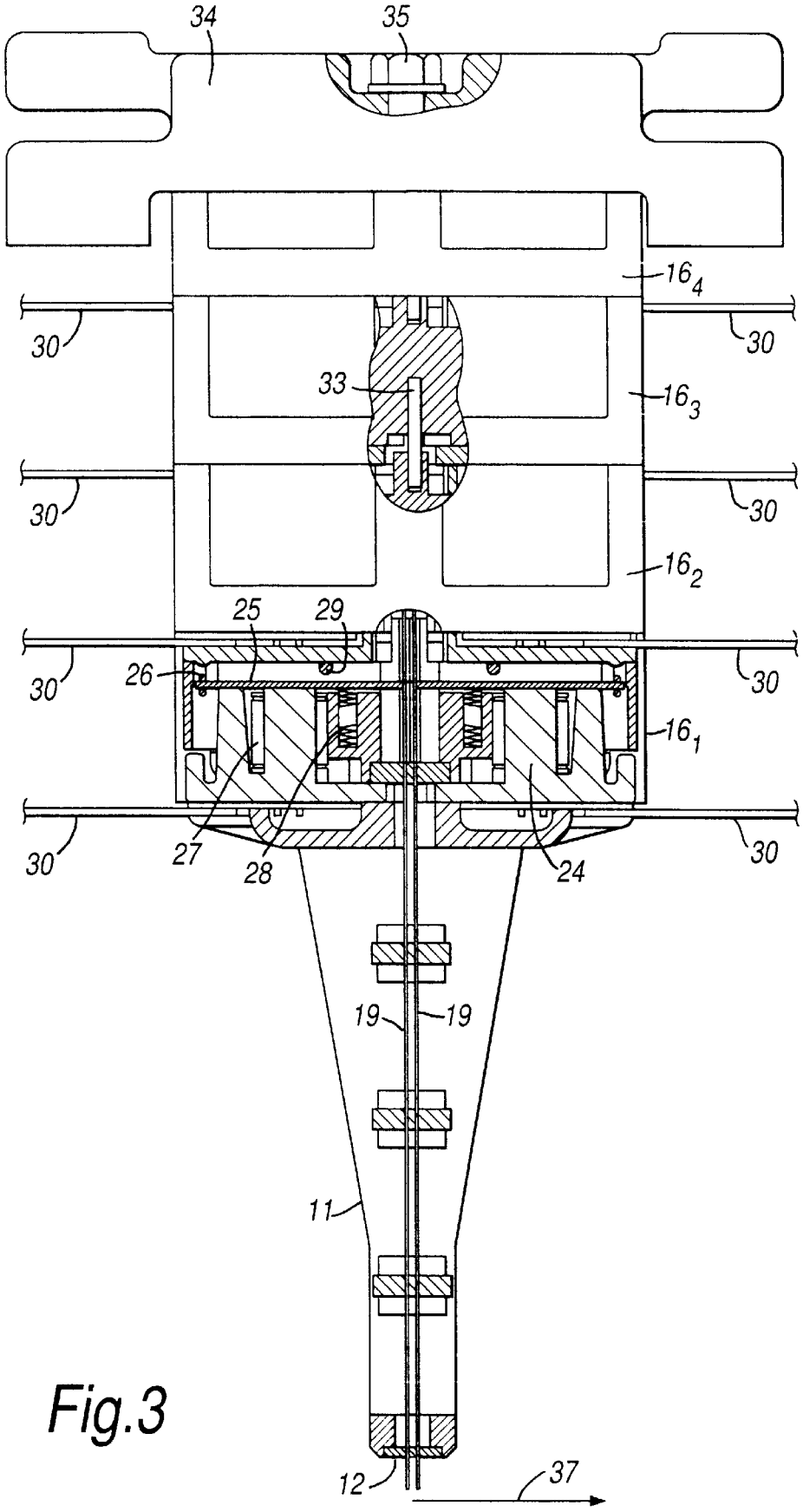
FIG. 3 is a side elevation of the print head to a larger scale than that of FIG. 1 and partly in section.
Figure 4:
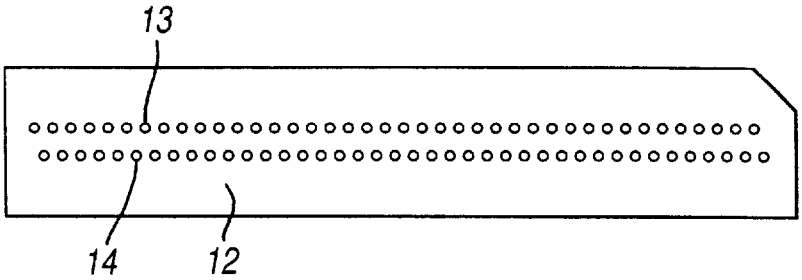
FIG. 4 shows a front guide for front ends of print wires of the print head.

Referring firstly to FIGS. 1, 2, 3 and 4 the print head has a body 10 housing actuators for print wires and the print wires extend from the actuators in the body 10, through a nose portion 11 disposed at the front of the print head, to a front guide plate 12 carried by the nose portion 11. The front guide plate 12 has a plurality of guide bores 13, 14 for locating and guiding front ends of print wires 30 As shown in FIG. 4, the guide bores 13 are disposed in a first line and the guide bores 14 are disposed in a second line parallel to and spaced from the first line. The guide bores 14 are offset in the direction of the line of bores 14 relative to the guide bores 13 such that the bores 14 are aligned with spaces between the bores 13.

Figure 5:
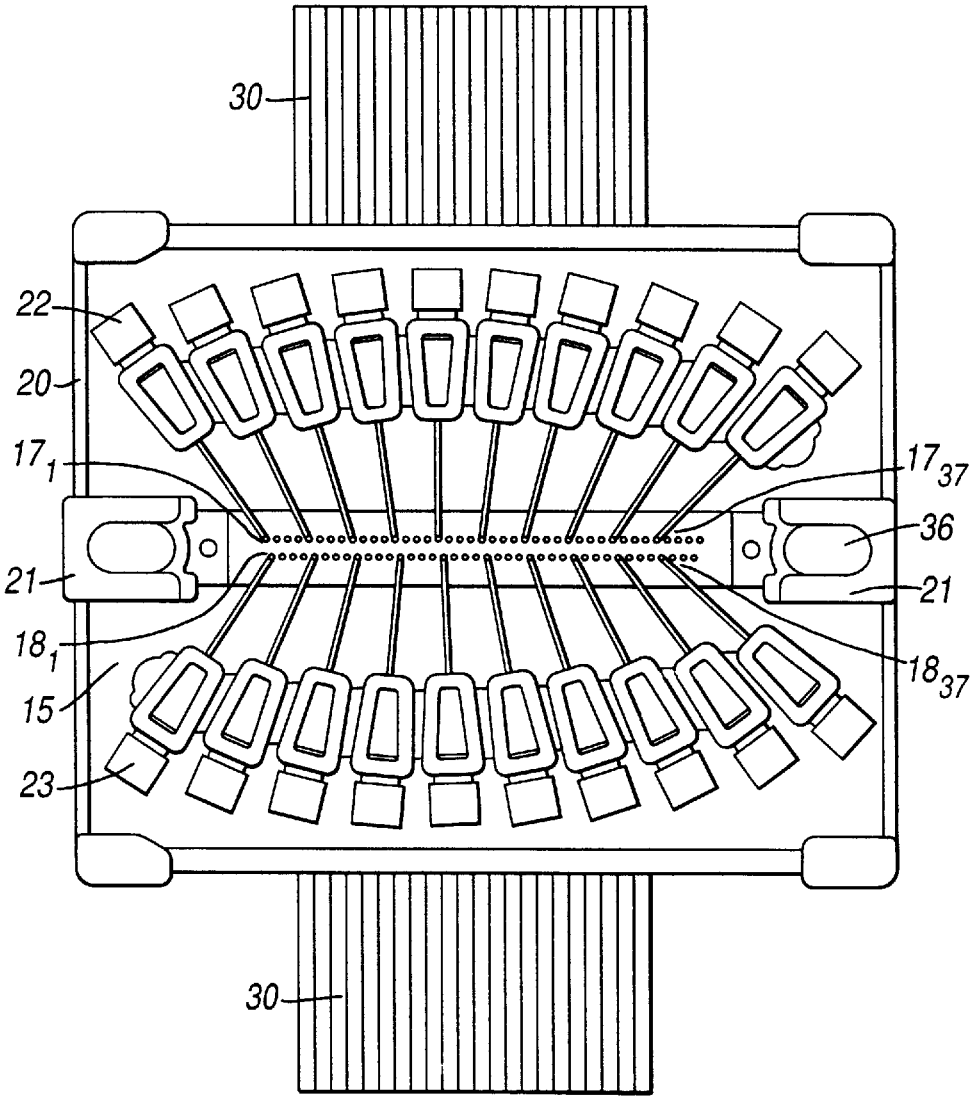
FIG. 5 is a plan view of one body element of the print head.

The body 10 of the print head comprises a stack of body elements $\mathbf{16}_1$, $\mathbf{16}_2$, $\mathbf{16}_3$ and $\mathbf{16}_4$. One of the body elements $\mathbf{16}_1$ is illustrated in plan view in FIG. 5. The body elements each comprise a base 15 having a plurality of guide bores $\mathbf{17}_1$ to $\mathbf{17}_n$and $\mathbf{18}_1$ to $\mathbf{18}_n$, 19 therein. The guide bores $\mathbf{17}_1$ to $\mathbf{17}_n$ correspond in locations and number to the guide bores 13 of the front guide 12 and the guide bores $\mathbf{18}_1$ to $\mathbf{18}_n$ correspond in locations and number to the guide bores 14 of the front guide plate 12. The base 15 is generally planar and extends perpendicular to the length of the print wires. A side wall 20 and a pair of projections 21 extend from the base. First and second sets of actuators 22, 23 are carried by the base 15. Each actuator comprises an electromagnet stator 24 carried by the base and an armature 25 pivotally mounted at 26. The stator 24 comprises a magnetic core of U shape and a drive coil 27 electromagnetically coupled to the core. The armature includes a magnetic element located so as to bridge the ends of the U shape core. When the coil of the stator is not energised with electric current, the armature is resiliently biased by a spring 28 to a rest position such that the magnetic element thereof is spaced from the open ends of the U shaped core of the stator and engages a resilient stop 29. When a pulse of electric current is passed through the drive coil, a magnetic field is generated in the core effective to apply a force to the armature such as to cause the armature to pivot toward the stator to the position shown in FIG. 3. Connection of the drive coils of the actuators to external circuits is provided by means multi-conductor ribbon cables 30. The armatures of the first set of actuators 22 extend such that free ends thereof are aligned with the guide bores $\mathbf{17}_1$ to $\mathbf{17}_n$ in the base. An actuator 22 is provided for each nth guide bore $\mathbf{17}_1$ to $\mathbf{17}_n$ and for example as shown in FIG. 5 the free ends of the armatures are aligned respectively with every fourth guide bore. Thus free ends of the armatures are aligned with guide bores $\mathbf{17}_1$, $\mathbf{17}_5$, $\mathbf{17}_9$, $\mathbf{17}_{13}$, $\mathbf{17}_{17}$, $\mathbf{17}_{21}$, $\mathbf{17}_{25}$, $\mathbf{17}_{29}$, $\mathbf{17}_{33}$ and $\mathbf{17}_{37}$. The second set of actuators 23 are provided for operation of print wires located in the guide bores $\mathbf{18}_1$ to $\mathbf{18}_n$. Similarly the armatures of the second set of actuators extend such that free ends thereof are aligned with the guide bores $\mathbf{18}_1$ to $\mathbf{18}_n$ in the base, the free ends of armatures of the actuators 23 being aligned with every fourth one of the guide bores $\mathbf{18}_1$ to $\mathbf{18}_n$.

The body elements $\mathbf{16}_1$, $\mathbf{16}_2$, $\mathbf{16}_3$ and $\mathbf{16}_4$ are of identical construction and the body elements are stacked such that the body elements are progressively displaced relative to one another in the direction of the lines of the guide bores 17, 18. Thus the guide bores $\mathbf{17}_1$ and $\mathbf{18}_1$ of the second body element $\mathbf{16}_2$ are aligned with guide bores $\mathbf{17}_2$ and $\mathbf{18}_2$ of the first body element $\mathbf{16}_1$. Similarly guide bores $\mathbf{17}_1$ and $\mathbf{18}_1$ of the third body element $\mathbf{16}_3$ are aligned with guide bores $\mathbf{17}_2$ and $\mathbf{18}_2$ of the second body element $\mathbf{16}_2$ and with guide bores $\mathbf{17}_3$ and $\mathbf{18}_3$ of the first body element $\mathbf{16}_1$. Guide bores $\mathbf{17}_1$ and $\mathbf{18}_1$ of the fourth body element $\mathbf{16}_4$ are aligned with guide bores $\mathbf{17}_2$ and $\mathbf{18}_2$ of the third body element $\mathbf{16}_3$, with guide bores $\mathbf{17}_3$ and $\mathbf{18}_3$ of the second body element $\mathbf{16}_2$ and with guide bores $\mathbf{17}_4$ and $\mathbf{18}_4$ of the first body element $\mathbf{16}_1$. Print wires 19 having front ends thereof located in the guide bores 13, 14 of the front guide 12 extend rearwardly into the body of the print head in parallel formation. Considering first the print wires having front ends in the guide bores 13, a first group of print wires in positions numbered 1, 5, 9, 13, 17, 21, 25, 29, 33 and 37 extend only through corresponding guide bores of the first body element and are mechanically coupled to the free ends of the armatures of the first body element aligned with those corresponding guide bores. A second group of print wires in positions numbered 2, 6, 10, 14, 18, 22, 26, 30, 34 and 38 extend through corresponding guide bores of the first and second body elements and are mechanically coupled with those free ends of armatures of the second body element aligned with guide bores in position numbered 2, 6, 10, 14, 18, 22, 26, 30, 34 and 38. Similarly a third group of print wires extend into the third body element and a fourth group of print wires extend into the fourth body element. Thus rear ends of print wires of the first group are mechanically coupled to armatures of the actuators on the first body element and can be operated by selective energisation of the actuators of the first body element. Similarly, print wires of the second group are mechanically coupled to and can be operated by selective energisation of the actuators of the second body element, print wires of the third group are mechanically coupled to and can be operated by selective energisation of the actuators of the third body element and print wires of the fourth group are mechanically coupled to and can be operated by selective energisation of the actuators of the fourth body element. After operation of the print wires by the actuators to which they are coupled, the springs return the actuators to their rest positions engaging the resilient stops.

Location means are provided to ensure the required offset alignment of each body element relative to a body element adjacent thereto. Preferably the location means comprises means carried by or formed in or on each body element. Such location means are illustrated in FIGS. 2, 3 and 5 of the drawings. The location means comprises a location element 31 located between the projections 21 of the body element. The location element has a pair of bores 32 therein and a pair of pins 33, the pair of bores being formed in one face, the left face as seen in FIG. 2 and the pins extending from an opposite face, the right face as seen in FIG. 2. The pair of bores 32 and the pair of pins 33 are offset relative to one another, as shown in FIG. 2, in a transverse direction aligned with the rows of print wires and are aligned with one another, as shown in FIG. 3, in a transverse direction perpendicular to the lines of print wires. When the body elements $\mathbf{16}_1$ $\mathbf{16}_2$, $\mathbf{16}_3$ and $\mathbf{16}_4$ are stacked with one another, the pins of one body element, for example $\mathbf{16}_2$, enter the bores of the body element $\mathbf{16}_1$ adjacent thereto and located nearer the front of the print head. Accordingly as a result of the relative location of the pins and bores on the location elements, adjacent body elements are displaced relative to one another in a transverse direction aligned with the lines of print wires but are aligned with one another in a transverse direction perpendicular to the lines of print wires. The nose piece 11 of the print head is aligned relative to the body element $\mathbf{16}_1$ adjacent the nose piece by the pins of that body element entering bores in the nose piece. Similarly, the body elements of the print head are aligned relative to a mounting member 34 for the print head by pins (not shown) extending from the mounting member entering the pair of bores of the rearmost body element $\mathbf{16}_4$. The nose piece, the body elements, and the mounting member are secured together by means of bolts 35 passing through elongate bores 36 in the projections of the body elements. It will be appreciated that by providing elongate bores having a dimension, in a direction aligned with the lines of print wires, greater than the diameter of the bolts, a clear passage through the bores is provided notwithstanding the offsettting of the body elements. While the pins and co-operating bores for locating the body elements relative to one another are described hereinbefore as being located on a location member mounted on the body member, if desired the pins and bores may be provided on the body member itself.

When mounted in printing apparatus, the print receiving medium is moved in a direction indicated by arrow 37 relative to the front of the print head and printing may be effected over a height 'h' on the print receiving medium. The height 'h' corresponds to the extent of the lines of guide bores 13, 14 and hence for a determined vertical density of printing, i.e. dots per mm, the number of print wires required is dependent upon the height 'h' over which printing is to be effected.

It will be appreciated that instead of four body elements and four groups of guide bores and print wires other numbers of body elements and groups of guide bores and print wires may be chosen. Generally the number of body elements and number of groups of guide bores and print wires will be dependent upon the number of print wires and the size of the actuators in relation to the spacing of adjacent print wires. Hence if a relatively large number of print wires are required it may be desired to accommodate the actuators in more than four body elements. Or, if relatively large actuators are required more body elements may be provided so that a reduced number of actuators is accommodated on each body element.

It will be appreciated that the manufacture of the body elements as identical units provides economies in manufacture and assembly of the body elements. Preferably each of the body elements is formed as an integral element, for example by moulding. The guide bores may be formed in the base or may be formed in a guide plate separate from the body element and secured relative to the corresponding body element.

It will be appreciated that the construction of print head described hereinbefore enables a relatively large number of straight print wires to be supported in parallel relationship to one another and for the relatively large number of actuators to be accommodated within a print head of which the transverse dimensions thereof are not excessively large. The transverse dimensions of a print head having 80 print wires arranged in two lines at a vertical dot pitch of 0.43 mm for printing over a height extent of 33.97 mm is not substantially greater than printing height and may be substantially the same as that of a conventional print head having only 18 wires in each of two rows for printing a single row of characters.

While a construction of print head in which the print wires have the front ends thereof located in two parallel lines has been described hereinbefore, it will be appreciated that the print wires may be located in a single line or more than two lines.

I claim:

1. An impact print head including a stack of at least first and second print head elements;

said first print head element including a first support, said first support having a first series of first print wire guide bores spaced at equal intervals along a first line; a set of first print wires, said first print wires extending parallel to one another and said first print wires extending one through each nth guide bore of said first series of first guide bores, respectively, a first set of actuators secured to said first support and operatively connected one to each said first print wire respectively;

said second print head element including a second support substantially identical to said first support, said second support having a second series of second guide bores spaced at said equal intervals along a second line and corresponding to said first series of first guide bores spaced along said first line; said second line being parallel to said first line; a set of second print wires, said second print wires extending parallel to one another and said second print wires extending one through each nth guide bore of said second series of second guide bores, respectively; a second set of actuators secured to said second support and operatively connected one to each said second print wire, respectively;

said first support being located offset relative to said second support in a direction parallel to said first line to an extent equal to said equal intervals so that each nth first guide bore is aligned with each (n+1)th second guide bore, respectively, and said first print wires extending through said nth guide bore of said first series of first guide bores of said first print head element also extend one through each (n+1)th second guide bore of said second series of second guide bores, respectively.

2. An impact print head including a stack of at least first and second print head elements, said first and second print head elements being of substantially identical construction; each print head element including a support, said support having a series of guide bores spaced at equal intervals along a line; a set of print wires, said print wires extending parallel to one another and said print wires extending one though each nth guide bore of said series of guide bores, respectively; a set of actuators secured to said support and operatively connected one to each said print wires, respectively; said first print head element being located relative to said second print head element such that the line of guide bores of said first print head element extends parallel to the line of guide bores of said second print head element and such that said first print head element is offset relative to said second print head element to an extent equal to the equal intervals in a direction parallel to the lines of guide bores so that print wires of the first print head element extending through the nth guide bores of the first element also extend through (n+1)th guide bores of the series of guide bores of said second print head element.

3. An impact print head as claimed in claim 2 including location means on said print head element; said location means including first means and second means; said second means of said location means on the second print head element engaging said first means of said location means on the first print head element and the engagement of the first and second means on the first and second print head elements, respectively, being effective to locate the first print head element with the offset relative to said second print head element.

4. An impact print head including a stack of first, second, third and fourth print head elements, said first, second, third and fourth print head elements being of substantially identical construction; each print head element including a support, said support having a series of guide bores spaced at equal intervals along a line; a set of print wires, said print wires extending parallel to one another and said print wires extending one through each 4th guide bore of said series of guide bores, respectively; a set of actuators secured to said support and operatively connected one to each said print wires, respectively;

said first, second, third and fourth print head elements being located relative to one another such that the lines of print wire guide bores of said first, second, third and fourth print head elements extend parallel to one another and such that each said print head element is offset relative to another of said print head elements to an extent equal to the equal intervals in a direction parallel to the lines of print wire bores so that print wires of the first print head element extending through each 4th guide bore of the series of guide bores of the first element also extend through each 5th guide bore of the series of guide bores of said second print head element, each 6th guide bore of the series of guide bores of said third element and each 7th guide bore of the series of guide bores of said fourth print head element.

* * * * *